US005560296A

United States Patent [19]

Adams

[11] Patent Number: 5,560,296

[45] Date of Patent: Oct. 1, 1996

[54] METHOD FOR CLEANING PRINTING CYLINDERS

[75] Inventor: Daniel A. Adams, Valey Park, Mo.

[73] Assignee: Union Camp Corporation, Wayne, N.J.

[21] Appl. No.: 391,878

[22] Filed: Feb. 22, 1995

[51] Int. Cl.[6] ..... B41M 7/02

[52] U.S. Cl. ..... 101/483; 101/424

[58] Field of Search ..... 101/483, 424, 101/423

[56] References Cited

U.S. PATENT DOCUMENTS

| | | | |
|---|---|---|---|
| 1,272,917 | 7/1918 | Cooke | 134/27 |
| 1,899,734 | 2/1933 | Stockton | 134/3 |
| 3,373,115 | 3/1968 | Steppan | 101/424 |
| 3,389,656 | 6/1968 | Giori | 101/424 |
| 3,681,141 | 8/1972 | Muoio | 134/41 |
| 4,130,443 | 12/1978 | Dulin | 134/33 |
| 4,402,758 | 9/1983 | Hobbs | 134/3 |
| 4,971,631 | 11/1990 | Sallee et al. | 134/3 |
| 5,291,827 | 3/1994 | Liers et al. | 101/424 |
| 5,382,294 | 1/1995 | Bondurant | 101/424 |

*Primary Examiner*—Edgar S. Burr
*Assistant Examiner*—Anthony H. Nguyen
*Attorney, Agent, or Firm*—Wendy A. Choi

[57] ABSTRACT

A method for cleaning a printing cylinder having a ceramic-coated surface embedded with dried printing ink residue or metal shavings is disclosed including the steps of:

(1) contacting the ceramic-coated surface of the printing cylinder with an acid solution for a period of time sufficient to dissolve the embedded dried printing ink residue and embedded metal shavings; and (2) neutralizing the acid solution.

The method of the invention is useful for removing dried printing ink residue and metal shavings which become embedded in the ceramic-coated surface of the printing cylinder during the printing operation, without damaging the ceramic-coated printing surface, especially after repeated cleanings, and without posing a waste disposal hazard.

5 Claims, No Drawings

METHOD FOR CLEANING PRINTING CYLINDERS

FIELD OF THE INVENTION

This invention relates to a method for cleaning printing cylinders, and more particularly, to a method for cleaning printing cylinders having a ceramic-coated surface used in flexographic printing.

BACKGROUND OF THE INVENTION

Flexographic printing is a process of rotary letterpress printing using flexible printing plates and fast drying inks. In the inking section of a flexographic printing process, an arrangement of printing cylinders carries a predetermined amount of ink to the printing plates. The most common type of inking section contains two inking cylinders or rolls: a fountain cylinder and a transfer cylinder. The fountain cylinder, usually rubber covered, carries ink from the ink pan to the nip between the two inking cylinders. At the nip, ink is metered to the transfer cylinder and carried by it to the plate or plates mounted on the plate cylinder. Depending upon the stock to be printed and the nature of the design, the transfer cylinder, also referred to as an anilox roll, may have a surface of rubber, chrome-plated smooth steel, chrome-plated etched steel, or ceramic-coated etched steel.

To fabricate a ceramic-coated cylinder, a cylinder is first undercoated with corrosion-resistant stainless steel. The cylinder is then topcoated with a fine ceramic in molten form via a plasma coating process. The final ceramic coating has a consistent density across the surface of the cylinder. After each coating is applied, the cylinder is ground to exact tolerances. Finally, ink-carrying cells are created by engraving the ceramic-coated surface with a high resolution laser to form a variety of patterns, volumes and screen lines typically having a length, width and depth in the range of 10–40 microns.

After use in a flexographing printing process, the ceramic-coated surface of the printing cylinder becomes embedded with the residue of dried printing ink. This embedded printing ink residue interferes with consistent transfer of a predetermined volume of printing ink and consequently reduces the high resolution and quality of the final printing.

In addition to the dried printing ink residue, the ceramic-coated surface is also damaged by metal shavings which become embedded in the surface and which interfere with the quality of the final printing. These metal shavings result from the excessive shearing of the metal doctor blade used to control the amount of printing ink delivered to the printing plates.

Organic solvent cleaning methods utilizing, for example, acetone, methyl ethyl ketone and trichloroethane and various alcohols, have been used to remove the printing ink residue from the ceramic-coated surface of the printing cylinder. These methods introduce health, safety and environmental concerns, particularly in the disposal of the spent organic solvent. In addition, they are somewhat inefficient in removing dried printing ink residue from the ceramic-coated surface.

Ultrasonic cleaning methods, such as those described in U.S. Pat. No. 5,291,827, have also been used to clean the dried printing ink residue embedded in the ceramic-coated surface of the printing cylinder by shocking the surface with sound vibrations of a frequency greater than about 20 kHz for about 5–30 minutes. However, ultrasonic cleaning methods are problematic because they weaken and eventually crack the ceramic-coated surface of the printing cylinder, especially after repeated cleanings.

SUMMARY OF THE INVENTION

The invention is directed to a method for cleaning a printing cylinder having a ceramic-coated surface with embedded dried printing ink residue or metal shavings, including the steps of:

(1) contacting the ceramic-coated surface of the printing cylinder with an acid solution for a period of time sufficient to dissolve the embedded dried printing ink and embedded shavings; and (2) neutralizing the acid solution.

The method of the invention is useful for removing dried printing ink residue and metal shavings which become embedded in the ceramic-coated surface of the printing cylinder during the printing operation, without damaging the ceramic-coated surface, especially after repeated cleanings, and without posing a waste disposal problem.

DETAILED DESCRIPTION OF THE INVENTION

The method of the invention includes at least two steps. The first step involves contacting the ceramic-coated surface of the printing cylinder with an acid solution. The second step involves neutralizing the acid solution.

The first step of the method of the invention is contacting the ceramic surface of the printing cylinder with an acid solution for a time sufficient to dissolve and dislodge the dried printing ink residue, metal shavings, or a combination of both ink and metal embedded in the ceramic surface from the printing operations. Generally, contact times of about five minutes to about one hour are required. However, the time required depends upon the strength of the acid solution utilized and the type and quantity of the printing ink and metal shavings which are embedded in the ceramic surface. Less time is required for contact with strong acid solutions, such as hydrochloric acid. Contact time may also be reduced by scrubbing or rubbing the ceramic-coated surface with an acid resistant brush, such as a brush fabricated from stainless steel, to aid in removal of the dried printing ink residue and metal shavings which are embedded in the surface, either manually or mechanically with a brush and an elliptical gear.

Suitable acid solutions may be prepared from inorganic mineral acids, such as hydrochloric acid, hydrobromic acid, hydriodic acid, hydrofluoric acid, sulfuric acid, perchloric acid, nitric acid, nitrous acid, phosphoric acid, carbonic acid and the like; and organic acids, including carboxylic acids, such as acetic acid, formic acid, benzoic acid and salicylic acid and dicarboxylic acids, such as oxalic acid, phthalic acid, sebacic acid and adipic acid and the like. The acid useful in the method of the invention may be employed in the form of an acid or water soluble acidic salt, such as sodium bisulfate. Mixtures of two or more acids may also be employed. Hydrochloric acid is preferred. It is preferred that hydrofluoric acid is not used alone, but in small quantities, in combination with hydrochloric acid to produce enhanced cleaning.

Typically, the level of acid concentration in the acid solution useful in the method of the present invention is from about 5% to about 50% by weight depending on the particular acid solution selected. Preferably, the level of acid concentration is from about 10% to about 25% by weight.

For hydrochloric acid, the preferred range is from about 31% to about 37%, by weight.

The acid solution may optionally contain other ingredients, provided that the optional ingredients are stable in an acid environment. Optional ingredients include, but are not limited to, dyes, fragrances, disinfectants, thickeners, surfactants, dispersants and the like.

pH indicators may be added to the solution to identify when the acid has spent its usefulness in cleaning the printing cylinders. These indicators include, but are not limited to, modified methyl orange, bromcresol green, methyl red, bromthymol blue, bromcresol purple, phenolphthalein and thymophthalein.

Any exposed steel parts of the printing cylinders, such as the journals, should be protected from the acid solution with a material such as grease, silicone and the like.

The second step of the method of the invention is neutralizing the acid solution. The acid solution may be neutralized by adding a fixed or volatile base to a pH of from about 6 to about 7 to form the acid salt. Suitable bases include sodium carbonate; hydroxides of the Group 1 and Group 2 metals, such as sodium hydroxide; ammonia, and the like. The pH may also be adjusted by diluting the acid solution with water.

Generally, the method of the invention is carried out at ambient temperatures. However, the method may be carried out at elevated temperatures.

The invention is further described in the following examples, which illustrate the method of the present invention. These examples are intended to be illustrative only, and are not to be construed as limiting the scope of the invention.

EXAMPLES

Example 1

The printing cylinder was removed from the printing device. The printing cylinder was then set horizontally within a plastic-coated or ceramic coated pan equipped with a drain and with stands having two sets of bearings. Exposed metal journals were protected from the acid solution with grease or silicone.

An acid solution of 50% water and 50% hydrochloric acid (29%) was added to the pan to a level of ⅛ inch to ¼ inch. Addition acid solution was added if the printing cylinder contained embedded metal pieces.

The printing cylinder was rotated in the acid solution while the ceramic-coated surface was scrubbed by hand in a circular motion with a stainless steel anilox brush.

After the dried printing ink residue and metal embedded in the cermamic-coated surface had been removed, the acid solution was neutralized with soda ash to a pH of 7.0. The neutralized acid solution was then drained from the pan.

The pan was then filled with an aqueous-based anilox cleaning solution. The printing cylinder was then rotated in the cleaning solution for 15 minutes. The aqueous-based anilox cleaning solution was then drained from the pan.

Finally, the pan was filled with water. The printing cylinder was then rotated in the cleaning solution to rinse any away remaining anilox cleaning solution.

The printing cylinders treated by the method of the invention were free from embedded dried printing ink residue and metal shavings after each treatment. Repeated treatments did not damage the ceramic-coated surface of the printing cylinders.

The disclosures of each patent and publication cited or described herein are hereby incorporated herein by reference, in their entirety.

Various modifications of the invention, in addition to those shown and described herein, will be readily apparent to those skilled in the art from the foregoing description. Such modifications are also intended to fall within the scope of the appended claims.

What is claimed is:

1. A method for cleaning a printing cylinder having a ceramic-coated surface, comprising the steps of:

(1) contacting the printing cylinder having a ceramic-coated surface with a cleaning solution consisting essentially of at least one aqueous acid solution for a period of time sufficient to dissolve embedded dried printing ink residue and embedded metal shavings; and (2) neutralizing said acid solution.

2. The method of claim 1 wherein said acid solution comprises an acid selected from the group consisting of hydrochloric acid, hydrobromic acid, hydriodic acid, hydrofluoric acid, sulfuric acid, perchloric acid, nitric acid, nitrous acid, phosphoric acid, carbonic acid, acetic acid, formic acid, benzoic acid salicylic acid, oxalic acid, phthalic acid, sebacic acid and adipic acid.

3. The method of claim 1 wherein said acid solution is a hydrochloric acid solution.

4. The method of claim 3 wherein said hydrochloric acid solution has a concentration of about 31% to about 37%, by weight based on the total weight of the aqueous acid solution.

5. The method of claim 1 further comprising the step of contacting the printing cylinder having a ceramic-coated with an aqueous anilox cleaning solution.

* * * * *